US007690313B2

(12) United States Patent
Sutter et al.

(10) Patent No.: US 7,690,313 B2
(45) Date of Patent: Apr. 6, 2010

(54) CABLEWAY SYSTEM WITH A SAFETY DEVICE

(75) Inventors: Josef Sutter, Bregenz (AT); Manfred Österle, Sulzberg (AT); Herbert Schwendinger, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 461 days.

(21) Appl. No.: 11/590,612

(22) Filed: Oct. 30, 2006

(65) Prior Publication Data

US 2007/0095244 A1 May 3, 2007

(30) Foreign Application Priority Data

Oct. 28, 2005 (AT) ..... A 1772/2005

(51) Int. Cl.
*B61B 7/06* (2006.01)
*B61B 11/00* (2006.01)

(52) U.S. Cl. ..... 104/117.1; 105/149.1

(58) Field of Classification Search ..... 104/89, 104/112, 115, 117.1; 105/148, 149.1, 149.2
See application file for complete search history.

(56) References Cited

U.S. PATENT DOCUMENTS 7,070,226 B2 * 7/2006 Cleland et al. ..... 296/146.8
7,114,451 B2 * 10/2006 Albrich et al. ..... 105/149.2
2002/0043829 A1 4/2002 Switzeny
2004/0003751 A1 1/2004 Albrich et al.

FOREIGN PATENT DOCUMENTS

| | | |
|---|---|---|
| DE | 2131456 | 12/1971 |
| DE | 2733295 A1 | 1/1978 |
| EP | 0255490 A2 | 2/1988 |
| EP | 1195305 A1 | 4/2002 |

OTHER PUBLICATIONS

European Search Report dated Apr. 29, 2008.
Austrian Search Report dated Feb. 29, 2008.

* cited by examiner

*Primary Examiner*—S. Joseph Morano
*Assistant Examiner*—Robert J McCarry, Jr.
(74) *Attorney, Agent, or Firm*—Laurence A. Greenberg; Ralph E. Locher; Werner H. Stemer

(57) ABSTRACT

A chairlift has chairs for conveying persons. The chairs may be detachably fastened to a haulage and conveying cable. A closing bar can be moved from a closed position into an open position and is mechanically connected by way of a Bowden cable or the like to a lever which interacts with rails that are arranged at the entry and exit of a station of the cableway system. In order to check whether the closing bar is completely opened or closed, a sensor for detecting the position of the actuating device is arranged in the region of the end of the rails as viewed in the conveying direction of the cable.

18 Claims, 5 Drawing Sheets

CABLEWAY SYSTEM WITH A SAFETY DEVICE

CROSS-REFERENCE TO RELATED APPLICATION

This application claims the priority, under 35 U.S.C. § 119, of Austrian application A 1772/2005, filed Oct. 28, 2005; the prior application is herewith incorporated by reference in its entirety.

BACKGROUND OF THE INVENTION

Field of the Invention

The invention relates to a cableway system with devices for conveying persons. The transport devices may, if appropriate, be detachably fastened to a cable and they have a safety device which can be moved from a closed position into an open position. The safety device is mechanically connected to an actuating device which interacts with a control device disposed at the entry and exit of a station of the cableway system.

Safety devices in devices for conveying persons can be gondola doors in the case of cable car systems, and closing bars or weatherproof covers (i.e., hoods) in the case of chairlifts. The safety devices are intended to prevent the persons to be conveyed from falling from the seat or from the gondola cabin while being transported. However, the safety devices are of course only active when they are completely closed during transport.

In order to ensure this, closing devices exist which automatically open the safety device upon entering a station, and automatically close the safety device upon exiting the station. However, a problem with this is that, during opening or closing, the opening or closing process can be obstructed by a passenger or by objects such as skis or ski poles. Were the opening or closing force too great in this case, injury could occur to the passenger or damage could occur to the objects, and it is imperative that this is avoided. In this case, however, it is no longer ensured that the safety device is completely closed and can perform its actual function.

SUMMARY OF THE INVENTION

The invention is therefore based on the object of providing a device which prevents passengers from falling from a chair or from a cabin, yet reliably prevents injury to the passengers or damage to objects as the safety device is being opened or closed.

With the above and other objects in view there is provided, in accordance with the invention, a cableway system having devices for conveying persons along a conveying cable between cableway stations, comprising:

a safety device mounted to the devices for conveying persons and movable between a closed position and an open position;

a control device disposed at an entry and an exit of a station of the cableway system;

an actuating device disposed to interact with said control device, said safety device being mechanically connected to said actuating device; and a sensor for detecting a position of said actuating device disposed in a region of an end of said control device in a conveying direction of the conveying cable.

In a preferred implementation of the invention, the devices for conveying persons are detachable from the conveying cable during a transport thereof through the cableway stations.

In other words, the objects of the invention are achieved in that a sensor for detecting the position of the actuating device is arranged in the region of the end of the control device as viewed in the conveying direction of the cable.

With the invention, it is detected at the end of the control device as to whether the actuating device has assumed the prescribed position. If this is not the case, the cableway can, for example, be stopped in order to completely open the safety device (when entering a station) or close the safety device (when exiting a station), and then to resume the journey. Since the position of the safety device is checked every time, the opening and closing force can be selected to be small enough that the risk of injury to passengers or of damage to objects can be avoided to the greatest possible extent.

The sensor could be arranged in the immediate end region of the control device. However, it is preferable within the context of the invention for the sensor to be arranged at a distance from the control device in the conveying direction. This gives sufficient time to completely open or close the safety device when there have been relatively minor problems, without it being necessary to interrupt the operation of the cableway.

It is possible within the context of the invention to provide efficient monitoring if the actuating device has a displacing member which can be displaced into a first and a second end position, and if the displacing member is displaced into one end position by the control device arranged at the entry, and into the other end position by the control device arranged at the exit.

In order to limit the opening and closing force, the control devices of the invention can preferably be displaced by the actuating device counter to a restoring force.

It is alternatively possible, however, for the displacing member to be mounted resiliently on the actuating device or for the displacing member to be connected resiliently to the safety device.

In all these cases, the spring force or restoring force can be set such that injury to persons or damage to objects can be avoided.

The restoring force of the control device can preferably be generated, for example, by a spring, a pressure medium cylinder or the like, or by a weight.

In the invention, the control devices can be rails which are preferably mounted so as to be pivotable, in order to make it possible to pivot them counter to the restoring force.

In one preferred embodiment of the invention, the rails have a run-in section which is inclined in the conveying direction, and a run-out section which is inclined in the opposite direction. The run-in section serves normally to open or close the safety device. If, however, there is an obstruction during opening or closing which prevents complete opening or closing and the cableway is therefore stopped because the sensor detects this, the opening or closing process must be repeated after the obstruction has been removed. This is preferably carried out by lift staff with the aid of a rod, by means of which the lever is rotated into the correct position. However, this could also be carried out using the run-out section which is inclined in the opposite direction, by moving the chair or cabin so far back that the opening or closing process is repeated as a result of the actuating device being moved along the run-out section.

In one preferred embodiment of the invention, the displacing member is a lever which is pivotable about a center of rotation and, at the end of one lever arm, has a roller which rolls on the control devices, the other lever arm of the lever being connected to the safety device by means of a connecting rod, a Bowden cable or the like. Here, that lever arm of the lever which is connected to the safety device is pivotable about its center of rotation over a dead point. This measure prevents the safety device, once it has been closed completely, from being opened again intentionally or unintentionally by a passenger.

The sensors used to monitor the position of the actuating device can be any suitable sensors, for example optical, electromagnetic or mechanical sensors.

Other features which are considered as characteristic for the invention are set forth in the appended claims.

Although the invention is illustrated and described herein as embodied in cableway having a safety device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
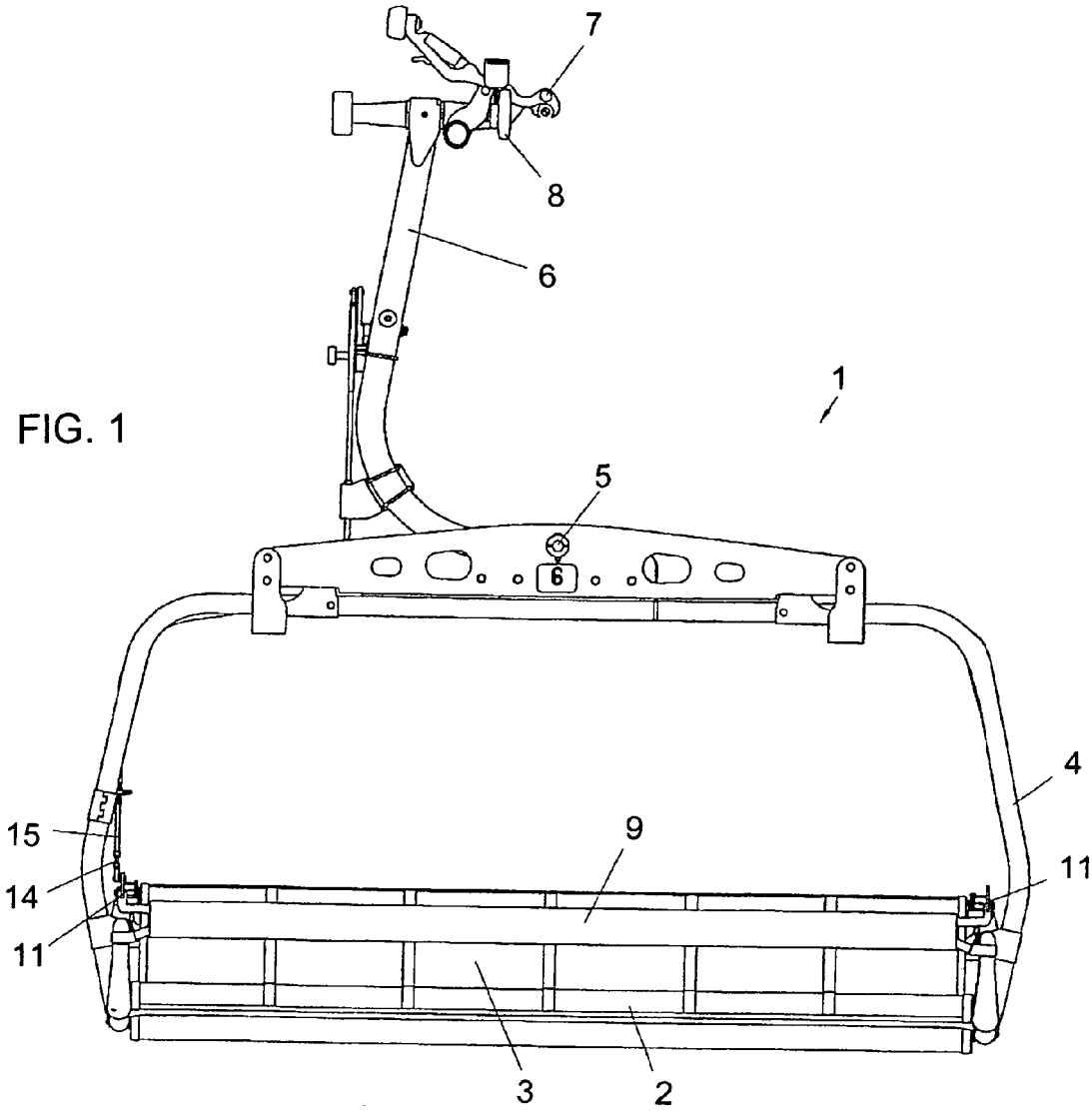
FIG. 1 shows the chair of a chairlift from the front.
Figure 2:
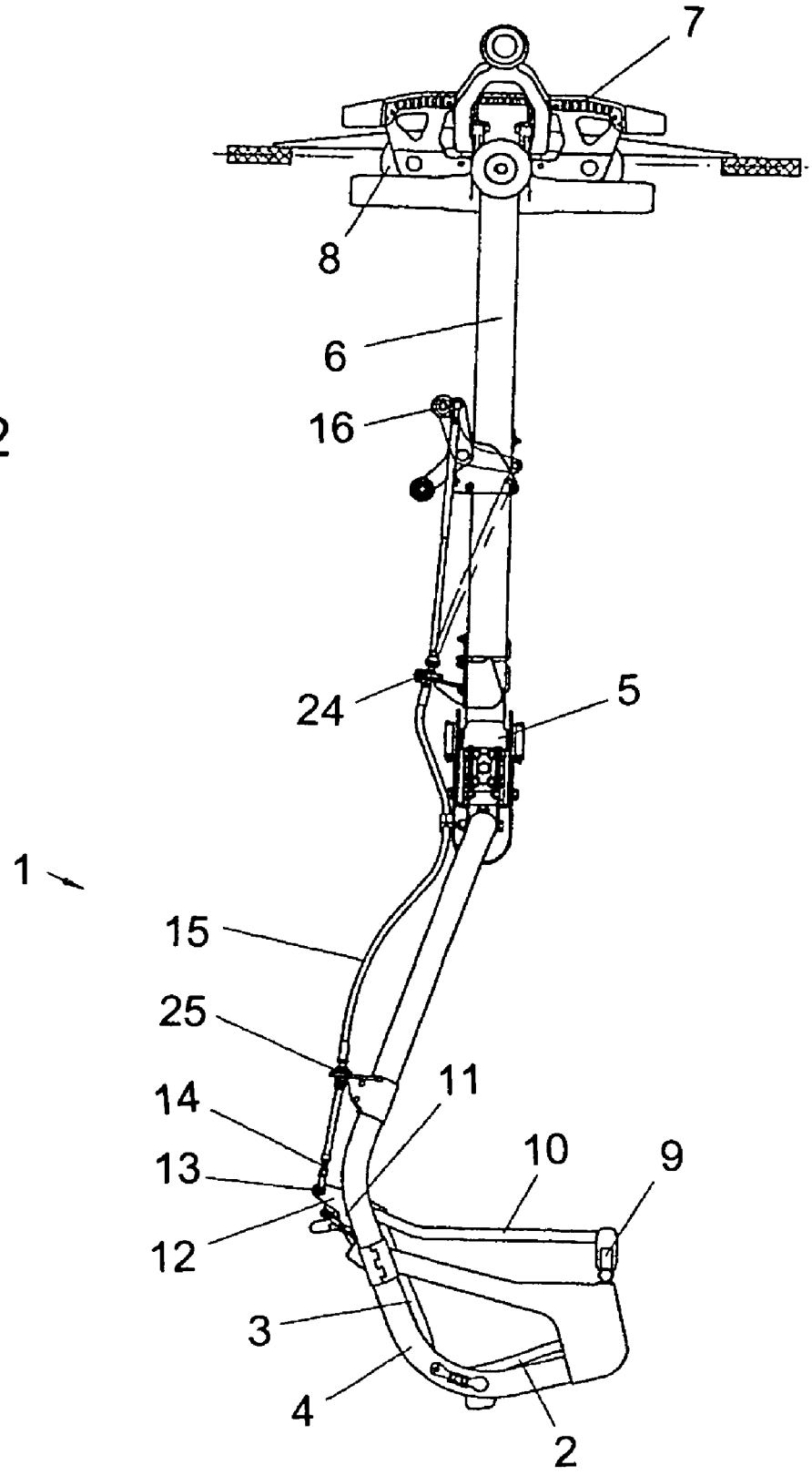
FIG. 2 shows the chair from FIG. 1 from the side.

Referring now to the figures of the drawing in detail and first, particularly, to FIGS. 1 and 2 thereof, there is shown a chair 1 of a chairlift system. The chair 1, here an exemplary six-person chair which is otherwise formed conventionally with a seat face 2 and a backrest 3 on a frame 4. The frame 4 is connected by way of an articulated joint 5 to a load-bearing rod 6, at the upper end of which is attached a clamping device 7 for fastening or coupling the chair 1 to a load-bearing and conveying cable. In addition, a running gear 8 is provided at the upper end of the load-bearing rod. The running gear 8 serves to move the chair 1 through the stations, along rails which are provided in the stations, after the chair 1 has been decoupled from the load-bearing and conveying cable.

A closing bar 9 with side struts 10 is mounted on the frame 4 by means of bearings 11 so as to be pivotable from a first position (illustrated in FIGS. 1 and 2), in which the closing bar 9 is situated in the region above the seat faces 2 and in front of the backrest 3, into a second position (not illustrated in the drawings) in which the closing bar 9 is situated substantially above the backrest 3. In the first position, the closing bar 9 prevents passengers from slipping or falling from the chair 1, whereas the passengers can sit on or leave the chair 1 without obstruction when the closing bar 9 is in its second position.

Figure 5:
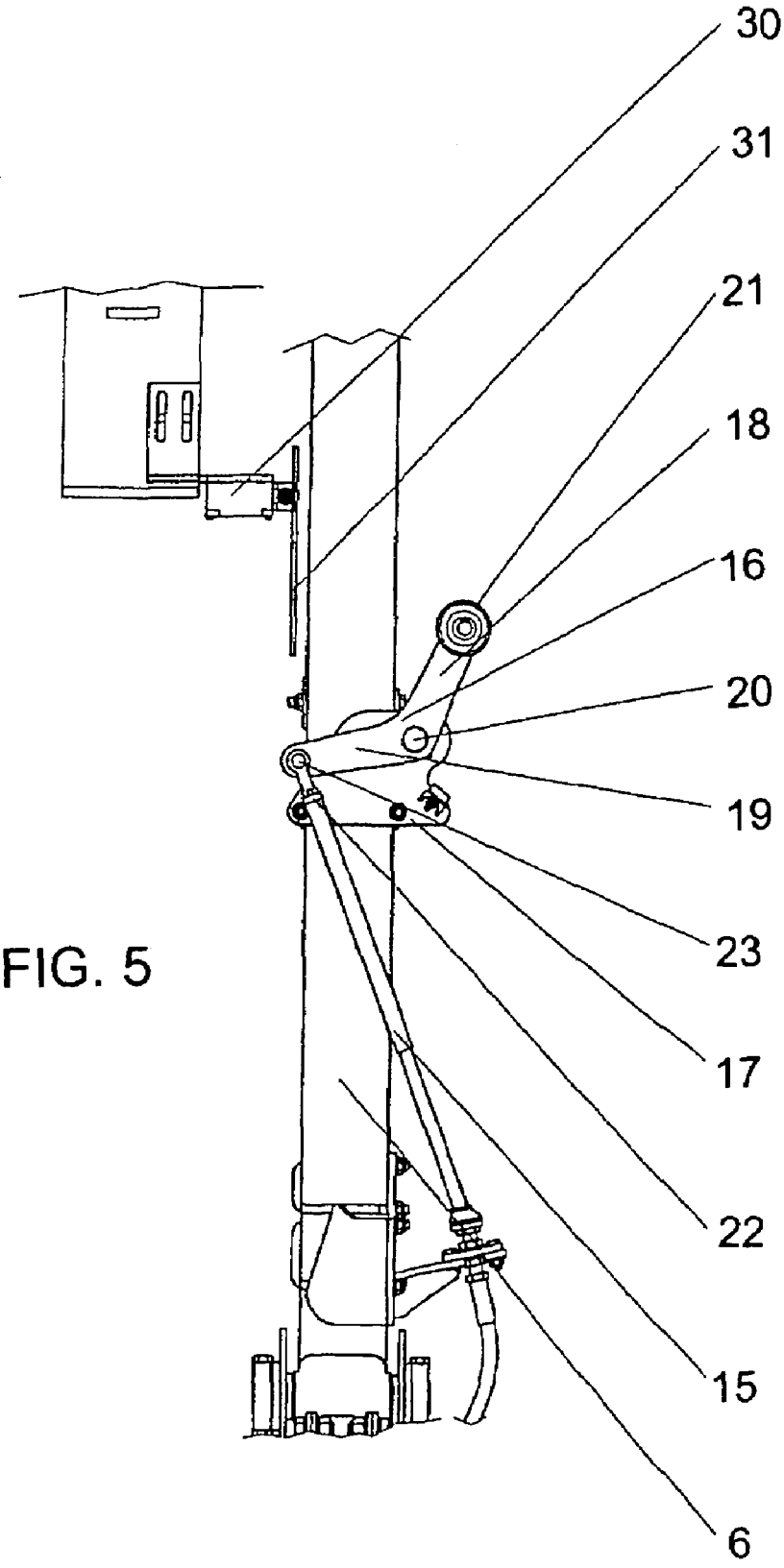
FIG. 5 shows a detail of the actuating device.

In order to automatically open and close the closing bar 9, an actuating device is provided which has a Bowden cable 15 and a lever 16. At the ends of the side struts 10, lugs 12 are situated in the region of the bearings 11, with a cable 14 of the Bowden cable 15 being fastened to the lugs 12 via an articulated joint 13. The lever 16 is pivotably mounted on the load-bearing rod 6 by means of a mounting plate 17, and has two lever arms 18, 19 which are arranged at an angle of approximately 125° about a pivot bearing 20 of the lever 16. FIG. 5 shows in detail the lever 16 when the closing bar 9 is in its open position. A roller 21 is mounted on one lever arm 18. The other end 22 of the cable 14 is mounted in a bearing 23 on the other lever arm 19. The sleeve of the Bowden cable 15 is fastened to the frame 4 and to the load-bearing rod 6 by means of brackets 24, 25.

If the lever 16 in FIG. 5 is rotated counter-clockwise through an angle of approximately 110°, the cable 14 and therefore also the lug 12 of the closing bar 9 is pulled, so that the latter is pivoted out of its open position into the position illustrated in FIGS. 1 and 2.

The two positions of the lever 16 are illustrated in FIG. 2, the position in which the closing bar 9 is closed being illustrated with solid lines, whereas the position of the lever 16 corresponding to the open position of the closing bar 9 is illustrated with dashed lines. It can be seen that the lever arm 19 and in particular its bearing 23 are moved over a dead point relative to the bracket 24 and the bearing 20, the dead point preventing the possibility of the closing bar 9 being opened again by hand, as this would require the cable end 22 to be pulled, but the lever 16 cannot be pivoted further as a result of a stop (not illustrated in any more detail) on the mounting plate 17.

Figure 3:
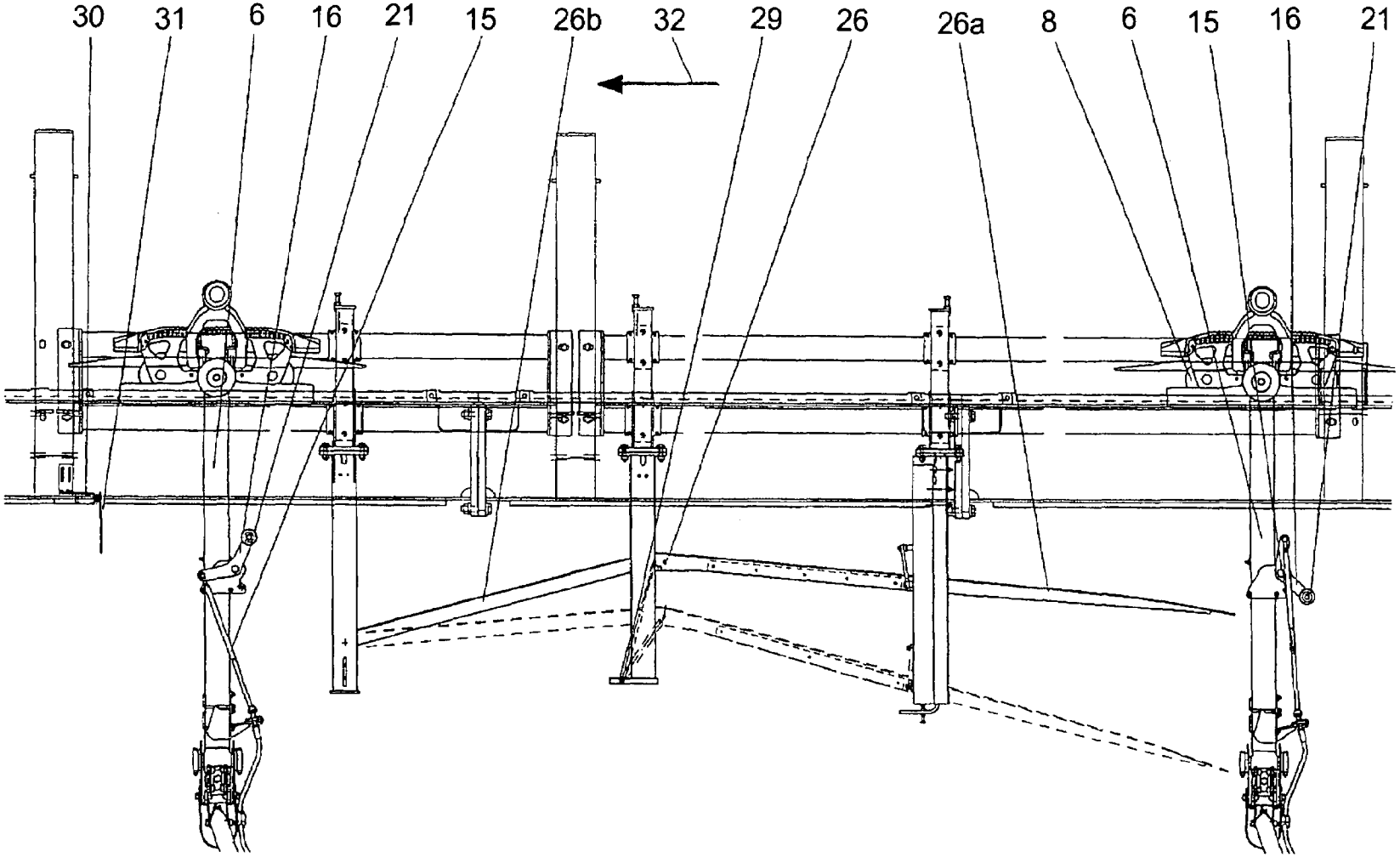
FIG. 3 shows a control device in the form of a rail in the entry region of a station.
Figure 4:
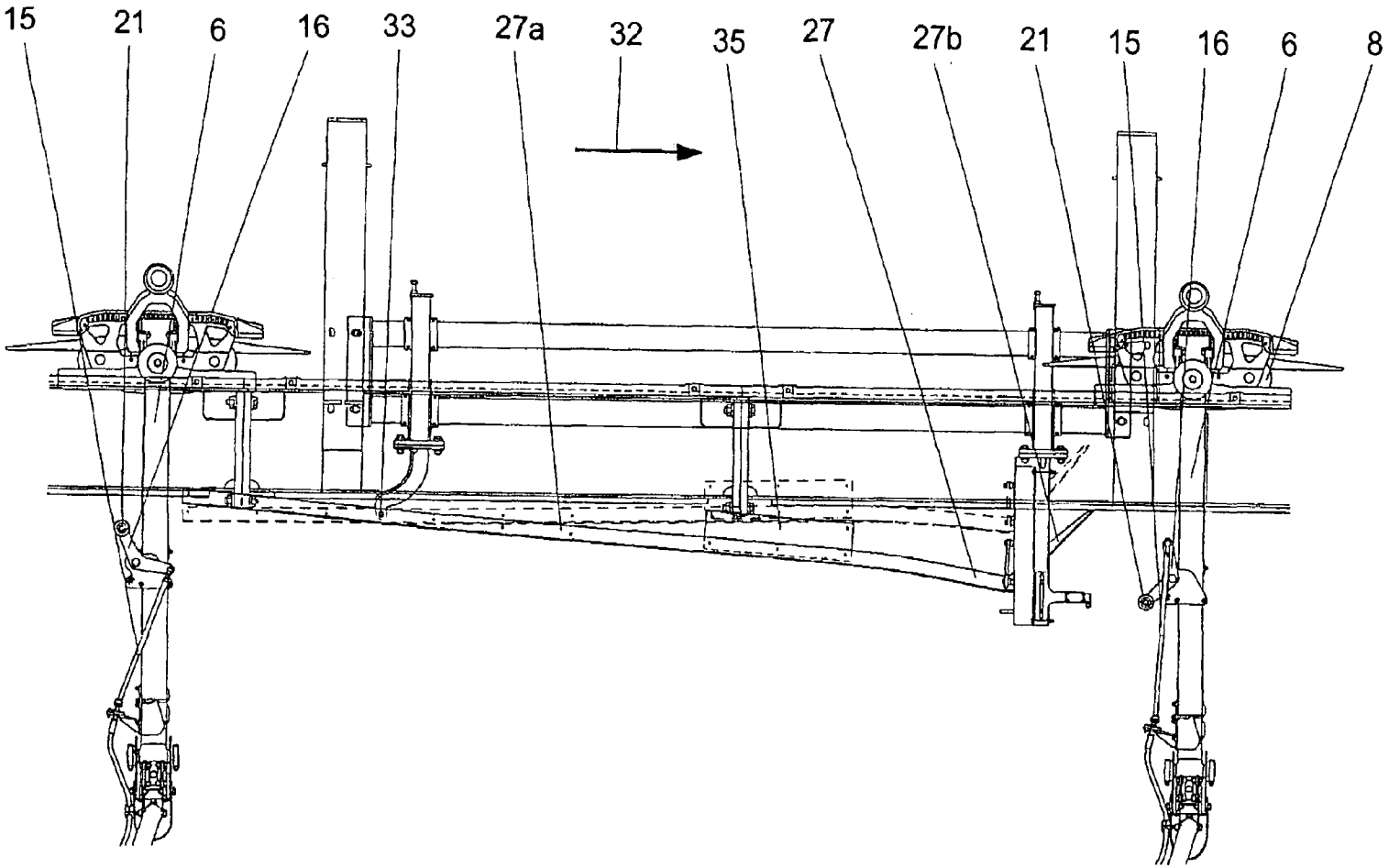
FIG. 4 shows a control device in the form of a rail in the exit region of a station.

To pivot the lever 16 and therefore to open and close the closing bar 9, control devices in the form of rails 26, 27 are arranged in the entry region and exit region of a station. FIG. 3 illustrates an entry region with the rail 26, and FIG. 4 illustrates an exit region with the rail 27. The normal conveying direction of the cableway is illustrated in each case by means of an arrow 32. In FIGS. 3 and 4, all that can be seen of the chair 1 are the load-bearing rod 6 and the upper end of the latter with the clamping device 7 and the running gear 8, and stationary station devices having running rails for the running gear 8 can also be seen.

The rail 26 has an inclined run-in section 26*a* and a run-out section 26*b* which is inclined in the opposite direction, and the rail 27 likewise has an inclined run-in section 27*a* and a run-out section 27*b* which is inclined in the opposite direction. When the chair 1 enters from the right in FIG. 3, the roller 21 of the lever 16 comes into contact with the upper side of the run-in section 26*a*, whereupon the lever 16 is rotated counter-clockwise, as a result of the inclination of the rail 26, until it reaches the position illustrated at the left of FIG. 3, in which position the closing bar 9 is open. If, however, the opening movement of the closing bar 9 is obstructed, the lever 16 should also rotate no further in order to avoid injury to passengers or damage to objects. In order to prevent the lever from having to rotate further as the chair moves onward, the rail 26 is pivotably mounted at one end on a bearing 28, so that the rail 26 can move into the position illustrated with dashed lines in FIG. 3 and can give way to the lever 16 and its roller 21. The force which the rail 26 exerts counter to the lever 16 is applied by a pressure medium cylinder, for example a gas cylinder 29, having an adjustable preload force.

A sensor 30 is situated in the region after the rail 26, the sensor 30 in the illustrated exemplary embodiment being a mechanical sensor with a contact finger 31 which is triggered by the roller 16 if, even after the rail 26, the roller 16 is still situated in the position illustrated at the right of FIG. 3. The chair 1 is then stopped and the problem is removed. This is carried out by lift staff by means of a rod, by means of which the lever 16 is rotated into the correct position. However, with a suitable design of the run-out section 26*b*, that is to say with a sufficiently small angle of the section 26*b* in the conveying direction 32, this could also be carried out by pushing the chair 1 counter to the normal conveying direction (arrow 32), resulting in the roller 21 of the lever 16 coming into contact with the run-out section 26*b* and subsequently being rotated counter-clockwise, resulting in the closing bar 9 being opened.

In FIG. 4, the process is the reverse of that from FIG. 3, that is to say that the chair 1, entering from the left with the closing bar 9 open and the roller 21 situated at the top, comes into contact with the lower side of the run-in section 27*a* of the rail 27. The lever 16 is rotated by the inclined run-in section 27*a* until it reaches the position illustrated at the right of FIG. 4, in which position the closing bar 9 is closed again. Should there be an obstruction as the closing bar 9 closes, the rail 27 can give way in that it can pivot upward about a bearing 33 in the region of its entry-side end 34. The force which the rail 27 exerts counter to the lever 16 is applied by its own weight, it being possible if required to adjust the force by means of an additional weight 35.

If a sensor (not illustrated in FIG. 4) corresponding to the sensor 30 in FIG. 3 determines that the lever 16 is not in the correct position, and the closing bar 9 is therefore not completely closed, the chair 1 is stopped again and the lever 16 is rotated by the lift staff by hand using a rod, whereupon the chair can be conveyed onward.

A spring (not illustrated) is attached to the rear side of the backrest 3, the spring being preloaded such that it acts on the closing bar 9 in the direction of its opening movement, in order to facilitate any required opening of the closing bar 9 by hand. This is of course only possible when the lever 16 is not in its blocked position (for example illustrated at the left of FIG. 4). In addition, the closing bar is held by the spring in the open position if the closing process (FIG. 4) was unsuccessful.

We Claim:

1. A cableway system having devices for conveying persons along a conveying cable between cableway stations, comprising:

a safety device mounted to the devices for conveying persons and movable between a closed position and an open position;

a control device in the form of rails respectively disposed at an entry and an exit of a station of the cableway system;

an actuating device disposed to interact with said control device, said safety device being mechanically connected to said actuating device; and a sensor for detecting a position of said actuating device disposed in a region of an end of said control device in a conveying direction of the conveying cable.

2. The cableway system according to claim 1, wherein said devices for conveying persons are configured to be detached from the conveying cable during a transport thereof through the cableway stations.

3. The cableway system according to claim 1, wherein said sensor is disposed at a distance from said control device in the conveying direction.

4. The cableway system according to claim 1, wherein said rails are displaceable by said actuating device counter to a restoring force.

5. The cableway system according to claim 4, which comprises a device for generating the restoring force selected from the group consisting of a spring and a pressure medium cylinder.

6. The cableway system according to claim 4, which comprises a weight for generating the restoring force.

7. The cableway system according to claim 1, wherein said rails are pivotally mounted.

8. The cableway system according to claim 1, wherein said rails are formed with a run-in ramp section inclined in the conveying direction, and a run-out ramp section inclined in a direction opposite the conveying direction.

9. The cableway system according to claim 1, wherein said displacing member is mounted resiliently on said actuating device.

10. The cableway system according to claim 1, wherein said displacing member is connected resiliently to said safety device.

11. A cableway system having devices for conveying persons along a conveying cable between cableway stations, comprising:

a safety device mounted to the devices for conveying persons and movable between a closed position and an open position;

a control device disposed at an entry and an exit of a station of the cableway system;

an actuating device disposed to interact with said control device, said safety device being mechanically connected to said actuating device; and a sensor for detecting a position of said actuating device disposed in a region of an end of said control device in a conveying direction of the conveying cable;

said actuating device including a lever pivotally mounted about a center of rotation and having a first lever arm with a free end carrying a roller disposed to roll on said control devices, and a second lever arm connected to said safety device.

12. The cableway system according to claim 11, wherein said second lever arm is connected to said safety device by way of a connecting rod or a Bowden cable.

13. The cableway system according to claim 11, wherein said first lever arm is pivotable about a center of rotation thereof through a dead point.

14. The cableway system according to claim 11, wherein the device for conveying persons is a lift chair and said safety device is a closing bar or a weatherproof cover hood pivotally mounted to the lift chair.

15. The cableway system according to claim 11, wherein the device for conveying persons is a gondola and the safety device is a gondola cabin door.

16. The cableway system according to claim 11, wherein said sensor is an optical sensor.

17. The cableway system according to claim 11, wherein said sensor is an electromagnetic sensor.

18. The cableway system according to claim 11, wherein said sensor is a mechanical sensor.

* * * * *